United States Patent [19]

Morris, Jr.

[11] Patent Number: 4,597,402

[45] Date of Patent: Jul. 1, 1986

[54] COLLAPSIBLE SHELTER

[76] Inventor: Lawrence J. Morris, Jr., 26729 Cypress St., Highland, Calif. 92346

[21] Appl. No.: 651,929

[22] Filed: Sep. 19, 1984

[51] Int. Cl.[4] ..... E04H 15/38

[52] U.S. Cl. ..... 135/102; 135/111

[58] Field of Search ..... 135/109, 111, 112, 110, 135/102, 103

[56] References Cited

U.S. PATENT DOCUMENTS

| | | | |
|---|---|---|---|
| 734,516 | 7/1903 | Collamore et al. | 135/109 |
| 2,798,501 | 7/1957 | Oliver | 135/102 |
| 2,975,792 | 3/1961 | Herbert et al. | 135/111 |
| 2,987,069 | 6/1961 | Presnick | 135/109 |
| 3,056,415 | 10/1962 | Nimmo | 135/111 |
| 3,465,765 | 9/1969 | Dietz | 135/102 |
| 3,540,458 | 11/1970 | Osterhoudt | 135/102 |
| 3,773,379 | 11/1973 | Loiseau | 135/102 |
| 3,955,228 | 5/1976 | Gaschenko et al. | 135/102 |
| 3,995,649 | 12/1976 | Robichaud | 135/102 |
| 4,402,544 | 9/1983 | Artim et al. | 135/102 |

FOREIGN PATENT DOCUMENTS

| | | | |
|---|---|---|---|
| 1036079 | 8/1958 | Fed. Rep. of Germany | 135/112 |
| 1279294 | 10/1968 | Fed. Rep. of Germany | 135/109 |
| 1427004 | 12/1965 | France | 135/102 |

*Primary Examiner*—Richard J. Johnson

*Attorney, Agent, or Firm*—James E. Brunton

[57] ABSTRACT

A collapsible structure comprising a close fitting cover which substantially encapsulates a light weight superstructure made up of a pair of U shaped, generally vertically extending members having ground engaging legs and a pair of U shaped generally horizontally extending members pivotally interconnected with the vertically extending members at locations elevated with respect to the ground. Certain of the pivotally interconnected members are constructed of different sizes and are freely pivoted relative to one another so that the structure can be collapsed into a highly compact configuration wherein the structural members nest within one another.

14 Claims, 8 Drawing Figures

COLLAPSIBLE SHELTER

BACKGROUND OF THE INVENTION

1. Field of the Invention

The present invention relates generally to collapsible shelters and more particularly to light weight, low cost shelters which can be made in a variety of sizes to accommodate persons, equipment or vehicles.

2. Discussion of the Prior Art

Various types of collapsible structures have been suggested in the past. Most of these structures are in the nature of small foldable tents, or the like, for use in providing personnel shelter. Typically, the prior art structures embody a ground engaging base of some type to which upwardly extending cover support members are inter-connected. Exemplary of such structures are those described in U.S. Pat. Nos. 3,995,649 and 3,540,458 issued to Robichand and Osterhoudt respectively.

In the Robichand patent the base structure, or frame 11, rests upon the ground and in one form of the invention comprises cooperatively associated telescoping members. In another form of the Robichand invention the base comprises a hinged rectangular structure which rests on the ground. In both forms of the invention the roof elements are supported by the base structure for pivotal movement from an extended to a collapsed configuration.

In the Osterhoudt patent the ground engaging base structure comprises pivotally interconnected members 18 and 20 to which the several roof elements are pivotally attached.

Unlike the prior art structures, the novel shelter of the present invention does not embody any type of ground engaging base structure. Rather, in the superstructure of the present invention, the pivotally interconnected structural members which form the enclosure are adapted to pivot about points elevated substantially above ground and only the end portions of the vertically disposed structural members touch the ground. In this way, the structural members, as well as the various pivot pins about which the members pivot, are protected from damage caused by corrosion resulting from engagement with the ground.

Additionally, because of the absence of a ground engaging base, the shelter of the present invention is considerably lighter and easier to manipulate than the prior art shelters of conventional design. Further, by eliminating the necessity for a ground engaging base structure, the number of structural components necessary to form the shelter can be minimized thereby reducing the cost of manufacture of the device.

Still another improvement of the shelter of the present invention over those of the prior art resides in the fact that, due to the minimum number of structural members employed and the unique sizing of these members, the shelter can be collapsed into a highly compact configuration with the structural members nesting within one another in a most novel fashion.

A further factor which differentiates the apparatus of the present invention from the prior art structures of typical construction is that the vertical frame members of the structure of the present invention pass along side the horizontal frame members forming "cross" intersections. In the prior art structures, the vertical and horizontal intersecting frame members typically terminate at the horizontal frame members thus forming "T" intersections.

In sharp contradistinction, the leg portions of the vertical frame members of the present invention continue as one unbroken piece of material past the pivot points. This provides the unique cooperative interaction of the structural members of the invention not found in the prior art structures.

Other advantages of the shelter of the present invention will become apparent from the discussion which follows.

SUMMARY OF THE INVENTION

It is an object of the invention to provide, as one embodiment of the invention, a collapsible structure comprising a cover adapted to be supported by a plurality of pivotally interconnected light weight structural members which, when in a noncollapsed configuration define an enclosed space sufficient in size to accommodate one or more persons.

It is another object of the invention to provide, as a second embodiment of the invention, a collapsible structure having structural support members of similar configuration but of a larger size so that the shelter can be used to house vehicles, large equipment and the like.

It is still another object of the invention to provide collapsible structures of the character described in the preceding paragraphs in which certain of the pivotally interconnected members are of different sizes and are freely pivoted relative to one another so that the structure can be folded into a highly compact configuration wherein the structural members nest within one another.

It is a further object of the invention to provide collapsible structures of the character described in which certain of the pivotally interconnected members are pivotally movable relative to one another so that the structure can be partially folded into a configuration which will permit ingress to and egress from the shelter by vehicles and large machines or other mechanisms.

Still another object of the invention is to provide collapsible structures of the class described which comprise a pair of U shaped, generally vertically extending members having ground engaging legs and a pair of U shaped generally horizontally extending members pivotally interconnected with said vertically extending members at locations elevated with respect to the ground. Releasable locking members are provided to maintain the horizontal members in an extended position when the structure is in a non-collapsed configuration.

Yet another object of the invention, is to provide structures as defined in the preceding paragraph in which the enclosure covers are weather tight and are closely fitted about the U shaped members so as to securely enclose the interior space defined thereby.

Finally, it is an object of the invention to provide a low cost, collapsible structure of the character described which is light weight, easy to collapse and erect, stable, durable, water tight and one which can be constructed in a variety of sizes to provide shelter for persons, vehicles, machines, patio furniture and the like.

DESCRIPTION OF THE INVENTION

Figure 1:
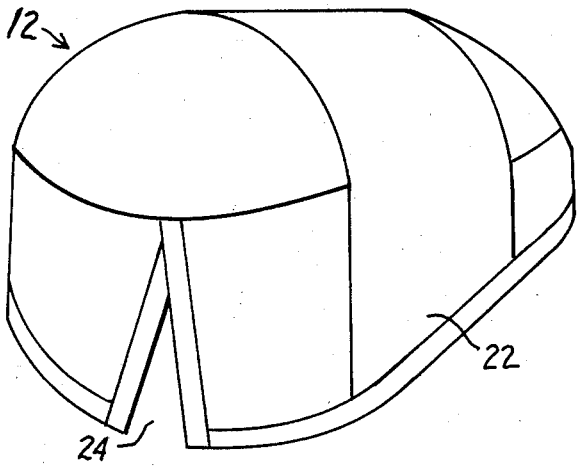
FIG. 1 is the generally perspective view of the collapsible shelter of the invention.
Figure 2:
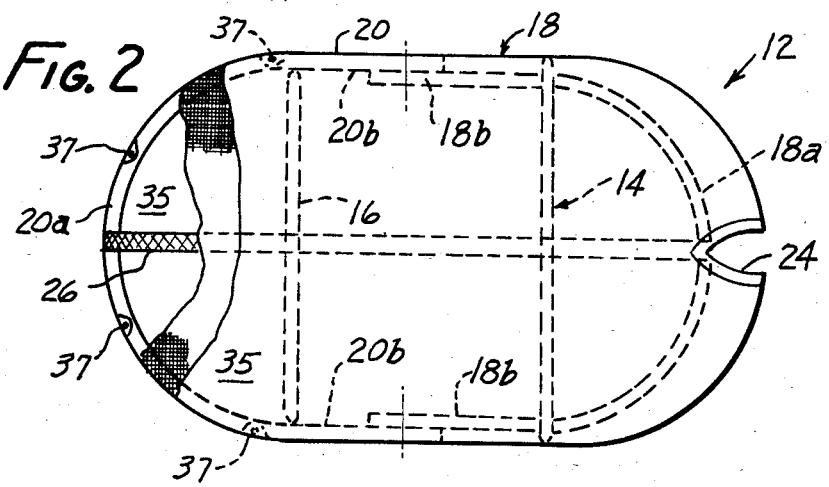
FIG. 2 is a top view partially broken away to show internal construction.
Figure 3:
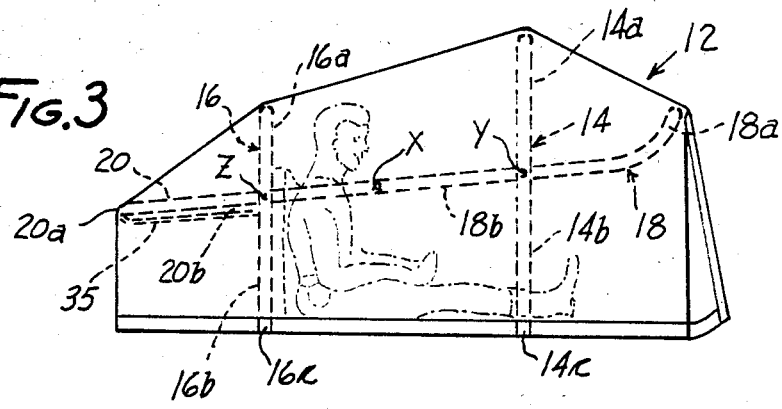
FIG. 3 is a side elevational diagrammatic view of the collapsible structure illustrating the structure in position over a user.

Referring to the drawings, and particularly to FIGS. 1 through 3 thereof, the collapsible shelter of the present invention, generally designated by the numeral 12, comprises first and second longitudinally spaced apart, generally vertically extending U shaped members, 14 and 16. Each of these U shaped members has an upper end, or bight, portion, designated in FIG. 3 by the numerals 14*a* and 16*a* respectively, and transversely spaced apart leg portions designated in FIG. 3 by the numerals 14*b* and 16*b*. The leg portions of each of the first and second members terminate in ground-engaging extremities, designated in FIG. 3 by the numerals 14*c* and 16*c*.

Cooperatively associated with first and second U shaped members 14 and 16, are third and fourth generally horizontally extending U shaped members 18 and 20. Each of these members has a bight, or outer end portion, designated by the numerals 18*a* and 20*a*, respectively. Similarly, each of the third and fourth members have transversely spaced apart leg portions designated in FIG. 2 by the numerals 18*b* and 20*b*, respectively.

As best seen in FIG. 3, third and fourth members 18 and 20 are pivotally inter-connected proximate the ends of the leg portions thereof for pivotal movement about a pivot axis designated in FIG. 3 by the letter "X". Leg portion 18*b* of third member 18 is pivotally connected to leg portions 14*b* of first member 14 at a location intermediate the bight portion thereof and the ground engaging extremities of leg portions 14*b*. With this construction, member 14 is pivotally movable relative to member 18, about an axis designated in FIG. 3 by the letter "Y". Similarly leg portions 20*b* of fourth member 20, are pivotally inter-connected with the leg portions 16*b* of second member 16 intermediate the bight portion thereof and the ground-engaging extremities 16*c* of leg portion 16*b*. With this construction member 16 is pivotally movable relative to member 20 about an axis designated in FIG. 3 by the letter "Z".

As illustrated in FIG. 1, when the collapsible structure of the invention is in its upstanding, erected position, a cover means is emplaced over and is supported by the first, second, third, and fourth members. This cover means which functions to enclose the interior space defined by the structural member, is here provided in the form of a lightweight mosquito netting, plastic or canvas member 22, which fits closely over the structural members. To permit ingress to and egress from the collapsible shelter of the invention when it is adapted for use as a tent or personnel enclosure, cover 22 is provided with access means in the form of a flap-like opening 24. As best seen in FIG. 3, to facillitate ingress and egress, the bight portion 18*a* of member 18 is curved upwardly relative to the plane of the leg portions 18*b*.

To assist in maintaining the structural elements in an upright, extended position, there is provided a tensioning means shown here as a flexible strap-like member, 26 (FIG. 2). Member 26 is inter-connected along its length with members 14, 16, 18 and 20 by suitable snaps or other connectors so as to hold the members in the non-collapsed configuration shown in FIGS. 1 through 3. It is to be understood that while members 26 is shown in the drawings in the form of a strap, it could also take the form of a length of cord or rope which is tied or otherwise secured to the structure of the invention.

The structural support members 14, 16, 18 and 20 can be constructed of a wide variety of materials, such as lightweight aluminum, aluminum alloy or plastic tubing. The tubing used should be relatively stiff and preferably impervious to moisture and corrosion, since the extremities 14*c* and 16*c* of the first and second members are in direct engagement with the ground when the shelter is in use. Caps or plugs may be used to seal the ends of the members against such things as dirt, moisture and the like.

Figure 4:
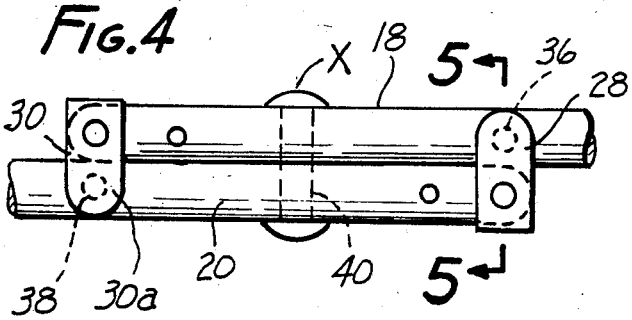
FIG. 4 is a fragmentary side elevational view illustrating the mechanism for pivotally interconnecting the structural frame members of the device.
Figure 5:
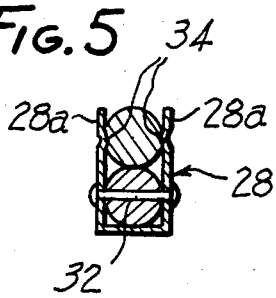
FIG. 5 is a cross-sectional view taken along lines 5—5 of FIG. 4.

Turning now to FIG. 4, the collapsible shelter of the instant form of the invention is provided with locking means for locking the leg portions of the third and fourth members 18 and 20 in a substantially coplanar relationship. In the embodiment of the invention shown in the drawings, these locking means are provided in the form of a pair of spaced-apart, generally U shaped brackets, 28 and 30 which are pivotally inter-connected with structural members 18 and 20, respectively. As indicated in FIG. 5, member 28 is inter-connected with the structural members by means of a pivot pin, or rivet, 32, and is adapted for pivotal movement about the axis of the pivot pin. Member 30 is similarly interconnected with the structural members. Each of the leg portions 28*a* and 30*a* of the brackets, is yieldably deformable and each is provided with a protruberance 34, which is adapted to be closely received within mating indentations 36 and 36, formed on either side of the structural members 18 and 20 respectively. With this detent-like construction, when members 18 and 20 are moved into a generally coplanar relationship as shown in FIG. 4, brackets 28 and 30 may be pivoted into the locking position with the protuberances 34 frictionally engaging the indentations 36 and 38 formed in members 18 and 20. In this way, the leg portions of the members 18 and 20 can be maintained in the substantially coplanar relationship of the character illustrated in FIG. 3. If desired, members 18 and 20 may also be provided with identations to stabilize brackets when not in use.

The various components of the collapsible shelter of the invention can be sized to permit a particular usage of the structure. For example, in the form of the invention shown in FIGS. 1 through 3, the components are sized so that the apparatus can be used as a personnel shelter. When so used, the apparatus can be provided with interior shelving or platforms such as that identified in FIG. 2 by the numeral 35. Such a shelf is conveniently held in position by snaps or brackets 37 which are carried by member 20.

Figure 6:
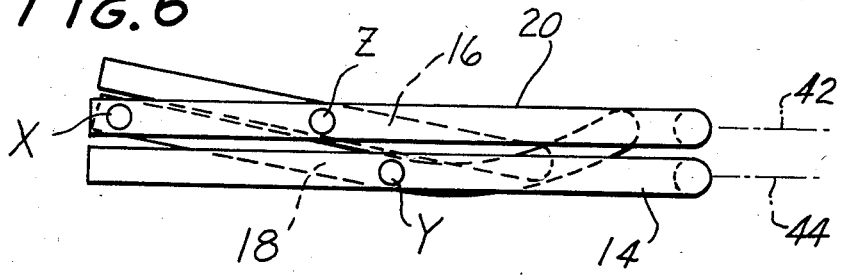
FIG. 6 is a view of the structural elements of the apparatus as they appear in a compact folded relationship.

Turning now to FIG. 6, when it is desired to collapse the structure into a storage or transport configuration, brackets 28 and 30 may be pivoted out of engagement with members 18 and 20 so that these members can be pivoted relative to one another about the axis "X", which axis is defined by a pivot pin or rivet 40 (FIG. 4). Similarly, member 18 can be pivoted relative to member 14 about a pivot pin defining pivot axis "Y" and member 20 can be pivoted relative to member 16 about a pivot pin defining pivot axis "Z".

A unique feature of the invention resides in the fact that the height of the first U shaped member 14 is greater than the height of the second U shaped member 16, while the first and fourth members 14 and 20 are substantially of the same size. With this construction, when the apparatus is collapsed into its storage configuration as shown in FIG. 6, the first and fourth members 14 and 20 are pivotally movable into a configuration wherein said members are disposed in closely adjacent parallel planes, designated generally by the numerals 42 and 44. As can also be seen in FIG. 6, when the apparatus is in the collapsed configuration, second and third members 14 and 18 are pivotally movable into a configuration wherein said members are contained substantially within the space defined by the parallel, closely adjacent members 14 and 20.

When the assemblage is folded into the configuration shown in FIG. 6, it can be conveniently transported or stored in a minimum amount of space. When it is desired to once again use the shelter, it can be quickly and easily erected without the use of special tools or skill.

Figure 7:
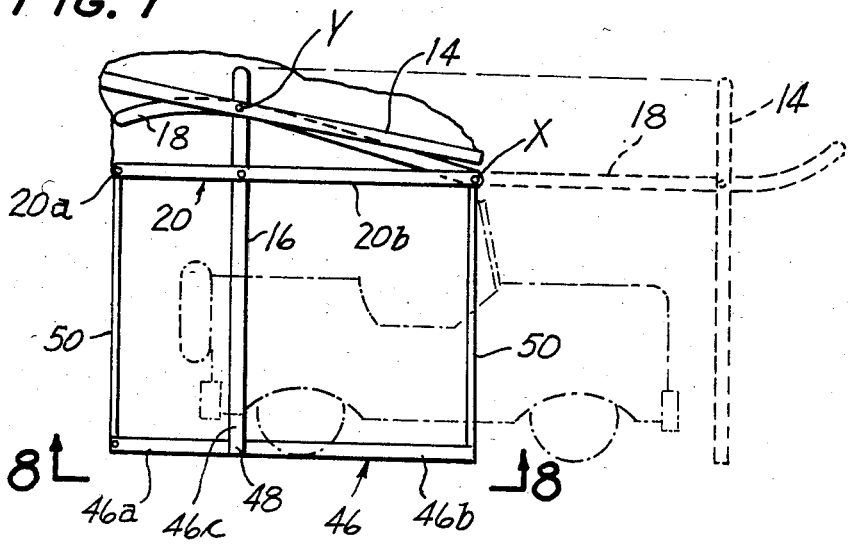
FIG. 7 is a side elevational diagrammatic view of another form of the collapsible structure of the invention which is larger in size and is adapted for use in the protective covering of the vehicles.
Figure 8:
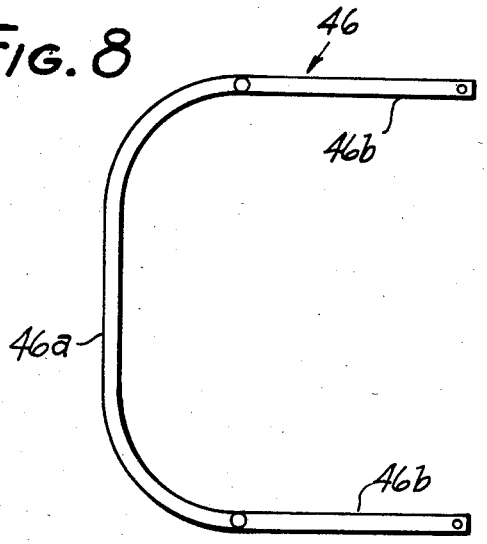
FIG. 8 is a view taken along lines 8—8 of FIG. 7.

Turning now to FIGS. 7 and 8, another embodiment of the collapsible structure of the present invention is there shown. This embodiment of the invention is closely similar to the embodiment of the invention shown in FIGS. 1 through 6 and like numerals are used to identify components of like configuration. As indicated in the drawings, the collapsible structure of FIGS. 7 and 8 is, however, substantially larger than the structures of the previously described embodiment and the interior space defined by the cooperating structural members is sufficient to accommodate the ingress to and egress from the structure of a passenger vehicle of the character illustrated in FIG. 7. Another difference in this form of the invention resides in the addition of a fifth, generally U shaped member 46, which member has a bight, or outer end, portion 46*a* and transversely spaced apart leg portions 46*b*. Fifth member 46 is pivotally interconnected with second member 16 at a location 48 which is proximate the ground engaging extremities 46*c* of leg portions 46*b*.

Also provided in the embodiment of the invention illustrated in FIGS. 7 and 8, are first connector means for interconnecting the bight portions 20*a* and 46*a* of members 20 and 46, respectively. Similarly, second connector means are provided for interconnecting the leg portions 20*b* and 46*b* of members 20 and 36 respectively. These connector means are provided here in the form of lengths of flexible canvas strapping 50 which are interconnected at either end to the structural members by tieing or by suitable mechanical connectors of a type well known in the art.

When the shelter of this latter form of the invention is erected, member 46 is disposed on the ground and straps 50 tend to hold the rearward portion of the structure in a stable configuration. To enter or remove the vehicle from the shelter only the forward end of the shelter need be folded from the position shown in the dotted lines of FIG. 7 into the position shown by the solid lines. This can be expeditiously accomplished by pivoting member 18 relative to member 20 about pivot axis X and by pivotng member 14 relative to member 18 about pivot axis Y. Of course, if it is desired to completely collapse the structure this can be done substantially in the manner previously described after releasing straps 50 and disconnecting member 46 from member 16.

Having now described the invention in detail in accordance with the requirements of the patent statutes, those skilled in this art will have no difficulty in making changes and modifications in the individual parts of their relative assembly in order to meet specific requirements or conditions. Such changes and modifications may be made without departing from the scope and spirit of the invention, as set forth in the following claims.

I claim:

1. A collapsible shelter having an interior space of a defined configuration said collapsible shelter being adjustable from an upstanding configuration to a collapsed storage, or transportable configuration, comprising:

(a) first and second longitudinally spaced apart, generally vertically extending members, each said member having an upper end portion and transversely spaced leg portions terminating in ground engaging extremities;

(b) third and fourth generally horizontally extending members, each said member having an interior space defining outer end portion and transversely spaced leg portions said leg portions having intermediate portions interconnected with said outer end portion and free ends, said leg portions of said third and fourth members being pivotally interconnected proximate said free ends, said leg portions of said third member being pivotally interconnected proximate said intermediate portions thereof with said leg portions of said first member intermediate said upper end portion thereof and said ground engaging extremities of said leg portions and said leg portions of said fourth member being pivotally interconnected proximate said intermediate portions thereof with said leg portion of said second member intermediate said upper end portion thereof and said ground engaging extremities of said leg portions; and (c) cover means supported by said first, second, third and fourth members for enclosing the interior space defined by said members, said cover means being in engagement with said upper end portions of said first and second members and being in engagement with said outer end portions of said third and fourth members whereby an interior space of a defined configuration is formed.

2. A collapsible shelter as defined in claim 1 including locking means for locking said leg portions of said third and fourth members in a substantially coplanar relationship.

3. A collapsible shelter as defined in claim 1 in which said outer end portion of said third member is curved in a generally upwardly direction relative to said leg portions.

4. A collapsible shelter as defined in claim 1 in which said first, second, third and fourth members are foldable relative to one another into a configuration wherein said leg portions of said members are in close proximity.

5. A collapsible structure as defined in claim 1 further including a fifth U shaped member having an outer end portion and transversely spaced apart leg portions said fifth member being pivotally interconnected with said second member at a location proximate said ground engaging extremities of said leg portions thereof.

6. A collapsible structure as defined in claim 5 further including first connector means for interconnecting said outer end portions of said fourth and fifth members and second connector means for interconnecting said leg portions of said fourth and fifth members.

7. A collapsible structure as defined in claim 6 in which said first, second, third, fourth and fifth members in a non-collapsed configuration define an interior space sufficient to accommodate a passenger vehicle.

8. A collapsible structure as defined in claim 1 in which said first and fourth members are substantially the same size and are pivotally movable into a configuration wherein said members are disposed in closely adjacent parallel planes and in which said second and third members are pivotally movable into a configuration wherein said members are disposed substantially within the space defined by said parallel, closely adjacent first and fourth members.

9. A collapsible shelter comprising:

(a) first and second longitudinally spaced apart, generally vertically extending U shaped members, each said member having a bight portion and transversely spaced leg portions terminating in ground engaging extremities;

(b) third and fourth generally horizontally extending U shaped members, each said member having a bight portion and transversely spaced leg portions said leg portions having intermediate portions interconnected with said bight portion and free ends, said leg portions of said third and fourth members being pivotally interconnected proximate said free ends thereof, said leg portions of said third member being pivotally interconnected proximate said intermediate portions thereof with said leg portions of said first member intermediate said bight portion thereof and said ground engaging extremities of said leg portions and said leg portions of said fourth member being pivotally interconnected proximate said intermediate portions thereof with said leg portions of said second member intermediate said bight portion thereof and said ground engaging extremities of said leg portions and (c) cover means supported by said first, second, third and fourth members for enclosing a substantial portion of the interior space defined by said members, said cover means including access means for ingress to and egress from the interior space.

10. A collapsible shelter as defined in claim 9 in which the height of said first U shaped member is greater than the height of said second U shaped member and in which said bight portion of said third member is curved upwardly relative to said leg portions thereof.

11. A collapsible shelter as defined in claim 10 in which said first and fourth members are substantially the same size.

12. A collapsible structure as defined in claim 11 in which said first and fourth members are pivotally movable into a configuration wherein said members are disposed in closely adjacent paralel planes.

13. A collapsible structure as defined in claim 12 in which said second and third members are pivotally movable into a configuration wherein said members are disposed substantially within the space defined by said parallel, closely adjacent first and fourth members.

14. A collapsible shelter having an interior space of a defined configuration, said collapsible shelter being adjustable from an upstanding configuration to a collapsed storage configuration, comprising:

(a) first and second longitudinally spaced apart, generally vertically extending U shaped members, said first member having a height greater than said second member, each said member having an interior space defining bight portion and transversely spaced leg portions each said leg portion having intermediate portions interconnected with said bight portions and having free ends terminating in ground engaging extremities;

(b) third and fourth generally horizontally extending U shaped members, each said member having an interior space defining bight portion and transversely spaced leg portions, said leg portions having intermediate portions interconnected with said bight portion and free ends, said leg portions of said third and fourth members being pivotally interconnected proximate said free ends, said leg portions of said third member being pivotally interconnected proximate said intermediate portions thereof with said leg portions of said first member proximate said intermediate portions thereof and said leg portions of said fourth member being pivotally interconnected proximate said intermediate portions thereof with said leg portions of said second member proximate said intermediate portions thereof; and (c) cover means supported by said first, second, third and fourth members for enclosing a substantial portion of the interior space defined by said members, said cover means including access means for ingress to and egress from the interior space; said first and fourth members being pivotally movable into a configuration wherein said members are disposed in closely adjacent parallel planes and in which said second and third members are pivotally movable into a configuration wherein said members are disposed substantially within the space defined by said parallel closely adjacent first and fourth members.

* * * * *